US011384711B2

(12) United States Patent
Kashima et al.

(10) Patent No.: US 11,384,711 B2
(45) Date of Patent: Jul. 12, 2022

(54) ENGINE

(71) Applicant: HONDA MOTOR CO., LTD., Tokyo (JP)

(72) Inventors: Soji Kashima, Saitama (JP); Toshiro Kiura, Saitama (JP); Kota Tokubi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/982,777

(22) PCT Filed: Mar. 30, 2018

(86) PCT No.: PCT/JP2018/013847
§ 371 (c)(1),
(2) Date: Sep. 21, 2020

(87) PCT Pub. No.: WO2019/187097
PCT Pub. Date: Oct. 3, 2019

(65) Prior Publication Data

US 2021/0003093 A1 Jan. 7, 2021

(51) Int. Cl.
*F02F 7/00* (2006.01)
*F01L 1/18* (2006.01)
(Continued)

(52) U.S. Cl.
CPC ..... *F02F 7/0004* (2013.01); *F01L 1/18* (2013.01); *F01L 1/047* (2013.01); *F01L 1/146* (2013.01);
(Continued)

(58) Field of Classification Search
CPC ..... F02F 7/0004; F02F 7/0053; F02F 7/006; F02F 7/0058; F02F 1/002; F01L 1/18;
(Continued)

(56) References Cited

U.S. PATENT DOCUMENTS 4,433,964 A * 2/1984 Holtzberg ..... F02B 67/06 123/90.31
4,513,702 A 4/1985 Koga et al.
(Continued)

FOREIGN PATENT DOCUMENTS

CN 101012760 A 8/2007
CN 200961494 Y 10/2007
(Continued)

OTHER PUBLICATIONS

Jun. 19, 2018, International Search Report issued for related PCT application No. PCT/JP2018/013847.
(Continued)

*Primary Examiner* — Grant Moubry
(74) *Attorney, Agent, or Firm* — Paratus Law Group, PLLC

(57) ABSTRACT

An engine (E) includes a crankcase body (19), a crankcase cover (20) covering a case opening portion (19*b*) of the crankcase body (19), a crankshaft (2), a cylinder base portion 21*a* located inside the crankcase body (19), a cylinder block (21*b*) located outside the crankcase body (19). The crankcase cover (20) is detachably attached to an upper portion of the crankcase body (19).

5 Claims, 8 Drawing Sheets

(51) Int. Cl.

| | |
|---|---|
| *F01L 1/047* | (2006.01) |
| *F01L 1/14* | (2006.01) |
| *F01L 1/053* | (2006.01) |

(52) U.S. Cl.
CPC ..... *F01L 2001/0476* (2013.01); *F01L 2001/0537* (2013.01); *F02F 7/006* (2013.01); *F02F 7/0053* (2013.01)

(58) Field of Classification Search
CPC ... F01L 1/047; F01L 1/146; F01L 1/14; F01L 2001/0476; F01L 2001/0537; F02B 75/007
See application file for complete search history.

(56) References Cited

U.S. PATENT DOCUMENTS

| | | | | |
|---|---|---|---|---|
| 4,873,945 | A * | 10/1989 | Tamba | F02B 75/22 123/54.4 |
| 6,250,273 | B1 | 6/2001 | Ryu et al. | |
| 6,837,207 | B2 | 1/2005 | Bonde et al. | |
| 7,077,089 | B2 * | 7/2006 | Hudak | F01L 1/146 123/196 R |
| 7,886,714 | B2 * | 2/2011 | Kashima | F01L 1/181 123/347 |
| 9,212,574 | B2 * | 12/2015 | Kashima | F01L 13/085 |
| 10,240,509 | B2 * | 3/2019 | Nishi | F01P 1/02 |
| 2004/0011318 | A1 | 1/2004 | Bonde et al. | |
| 2004/0094113 | A1 * | 5/2004 | Honda | F01M 1/04 123/196 R |
| 2005/0229893 | A1 | 10/2005 | Miyake et al. | |
| 2012/0073527 | A1 | 3/2012 | Oltmans et al. | |
| 2013/0133612 | A1 | 5/2013 | Mori et al. | |
| 2015/0144096 | A1 | 5/2015 | Meneely et al. | |
| 2017/0260880 | A1 | 9/2017 | Kono | |

FOREIGN PATENT DOCUMENTS

| | | | | | |
|---|---|---|---|---|---|
| CN | 100348855 | C | | 11/2007 | |
| CN | 201963396 | U | | 9/2011 | |
| CN | 205559001 | U | | 9/2016 | |
| EP | 1627995 | A2 | | 2/2006 | |
| JP | S58-074856 | A | | 5/1983 | |
| JP | 2001-115814 | A | | 4/2001 | |
| JP | 2004-060453 | A | | 2/2004 | |
| JP | 2004-278453 | A | | 10/2004 | |
| JP | 2005-120973 | A | | 5/2005 | |
| JP | 2011074877 | A | * | 4/2011 | F01M 11/00 |
| JP | 2013-113223 | A | | 6/2013 | |
| JP | 2017-160833 | A | | 9/2017 | |

OTHER PUBLICATIONS

Jun. 19, 2018, International Search Opinion issued for related PCT application No. PCT/JP2018/013847.
Feb. 10, 2021, European Search report issued for related EP application No. 18912218.7.
Jul. 13, 2021, Japanese Office Action issued for related JP application No. 2020-508860.
Aug. 25, 2021, Chinese Office Action issued for related CN application No. 201880091003.7.
Oct. 5, 2021, Japanese Office Action issued for related JP application No. 2020-508860.
Jan. 4, 2022, European Communication issued for related EP Application No. 18912218.7.
May 19, 2022, Chinese Office Action issued for related CN Application No. 201880091003.7.

* cited by examiner

ENGINE

CROSS REFERENCE TO PRIOR APPLICATION

This application is a National Stage Patent Application of PCT International Patent Application No. PCT/JP2018/013847 (filed on Mar. 30, 2018) under 35 U.S.C. § 371, which is hereby incorporated by reference in its entirety.

TECHNICAL FIELD

The present invention relates to an engine which can be mounted on a working machine such as a lawn mower or a high pressure washer.

BACKGROUND ART

Generally, an engine includes a crankcase having first and second bearing portions which support both ends of a crankshaft and a cylinder into which a piston is fitted. For example, Patent Literature 1 discloses an engine in which a crankcase is formed of first and second case half bodies which are joined to each other at a dividing surface which diagonally intersects axes of first and second bearing portions and a cylinder and the first bearing portion are integrally formed on the first case half body, and further the second bearing portion is integrally formed on the second case half body.

Related Art Literature Patent Literature

Patent Literature 1: JP-A 2017-160833

SUMMARY OF THE INVENTION

Problem that the Invention is to Solve

However, in the engine structure of Patent Literature 1, the second case half body is to be removed at the time of maintenance of the engine, and when removing the second case half body, a case opening faces downward, so it is necessary to lower the engine from the frame and disassemble the engine with the case opening facing upward. As a result, there is a problem that the number of man-hours is increased.

The invention provides an engine which can reduce the number of man-hours required for maintenance.

Means for Solving the Problem

The invention is an engine which includes:

a crankcase body including a bottom portion including a first crankshaft insertion hole and a tubular portion including the bottom portion integrally formed at one end in a first direction and including a case opening portion at the other end in the first direction:

a crankcase cover including a second crankshaft insertion hole and covering the case opening portion of the crankcase body;

a crankshaft inserted through the first crankshaft insertion hole and the second crankshaft insertion hole;

a cylinder base portion located inside the crankcase body, and a cylinder block located outside the crankcase body, where the first direction is an up-down direction of the engine, and the crankcase cover is detachably attached to an upper portion of the crankcase body.

Advantages of the Invention

According to the invention, the crankcase cover is detachably attached to the upper portion of the crankcase body. Therefore, by removing the crankcase cover during maintenance of the engine, it is possible to access the inside of the crankcase body from the top.

MODE FOR CARRYING OUT THE INVENTION

Figure 1:
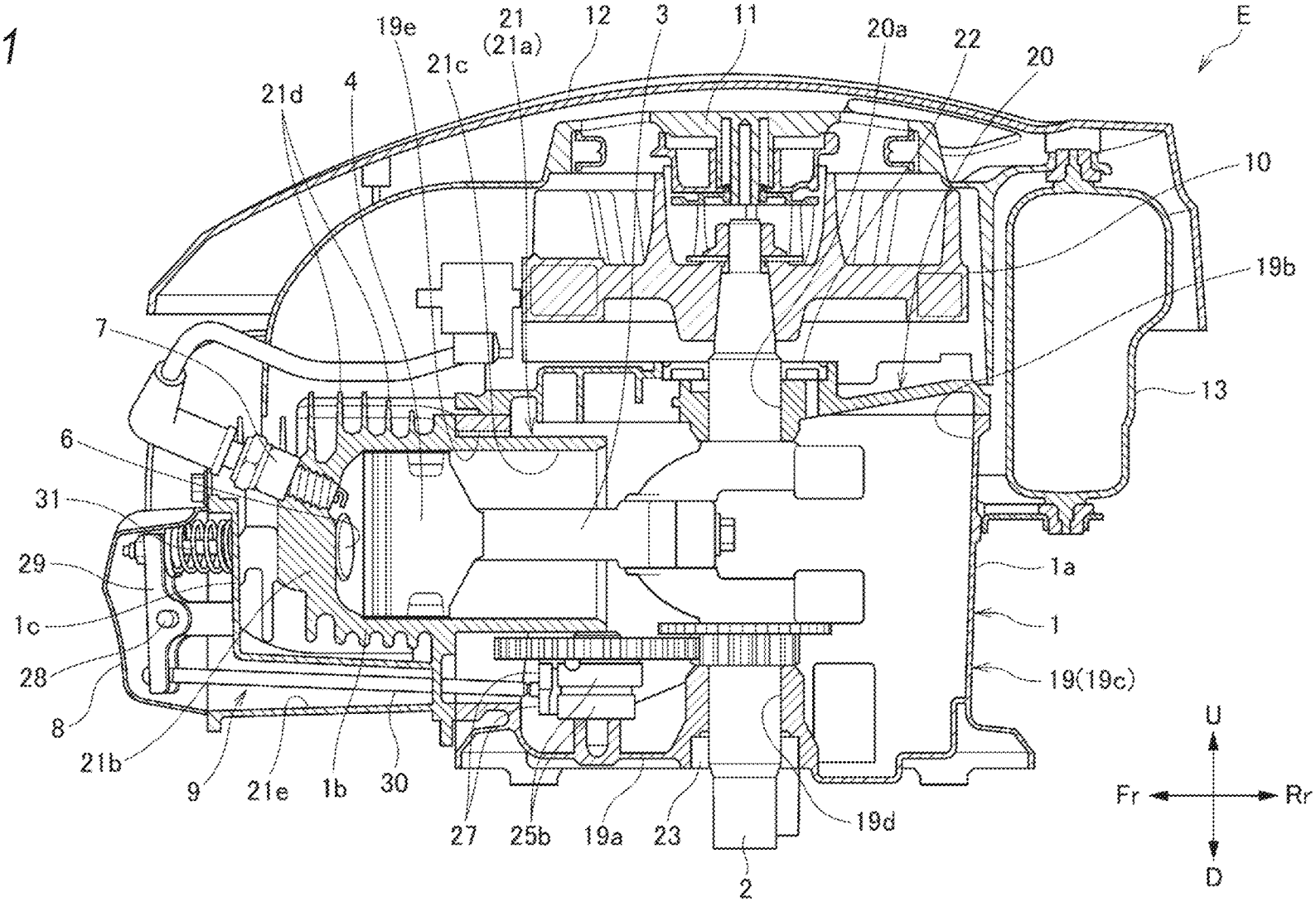
FIG. 1 is a cross-sectional view of an engine according to an embodiment of the invention.

Hereinafter, an embodiment of the invention will be described with reference to FIGS. 1 to 8. An engine E of the embodiment is a small general-purpose engine mounted on a walk-type lawnmower or the like and constitutes an OHV engine. In the present specification and the like, in order to simplify and clarify the explanation, an axial direction of a crankshaft 2 is defined as an up-down direction (first direction), a direction which is perpendicular to the up-down direction and in which a cylinder portion 1*b* extends is defined as a front-back direction (second direction), and a direction perpendicular to the up-down direction and the front-back direction is defined as a left-right direction. In the drawing, the front of the engine E is shown as Fr, the rear as Rr, the left as L, the right as R the upper as U, and the lower as D.

Figure 2:
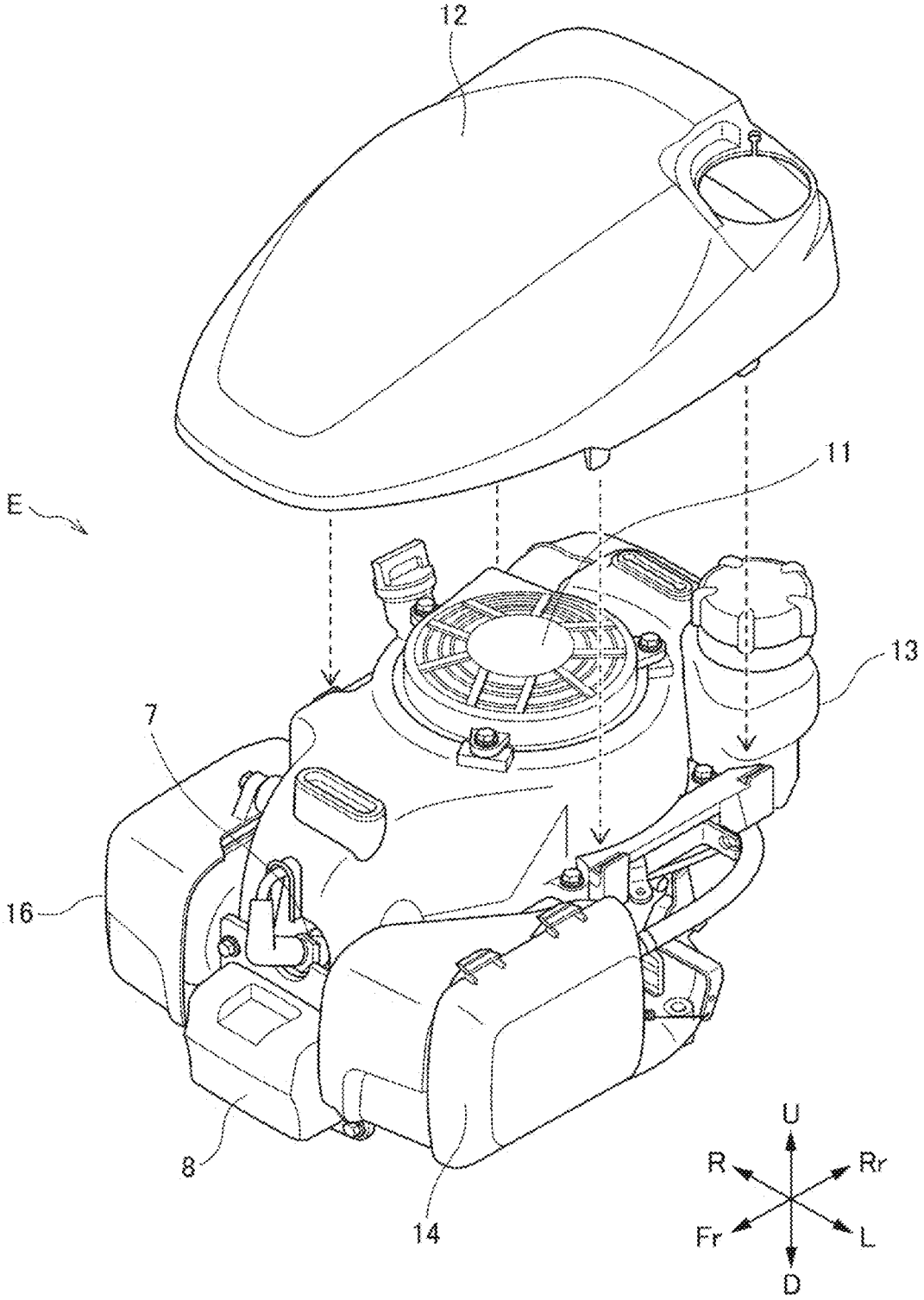
FIG. 2 is a perspective view of the engine with a top cover removed, as viewed from diagonally above and front.
Figure 3:
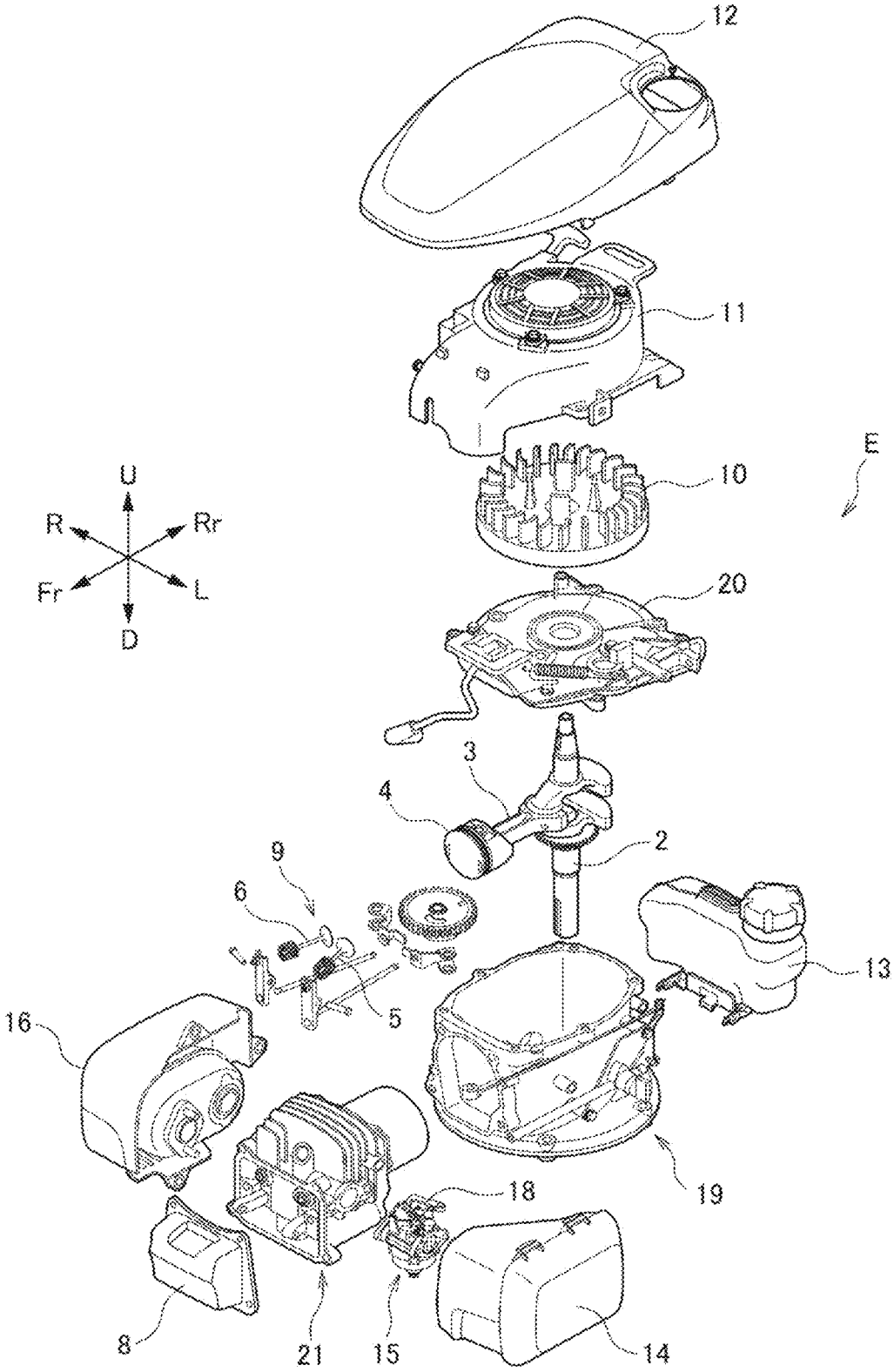
FIG. 3 is an exploded perspective view of the engine as seen from diagonally above and front.

As illustrated in FIGS. 1 to 3. the engine E of the embodiment includes an engine body 1 including a crankcase portion 1*a* and the cylinder portion 1*b*, the crankshaft 2 which is rotatably supported by the crankcase portion 1*a* in the up-down direction, a piston 4 slidably fitted in the cylinder portion 1*b* and connected to the crankshaft 2 via a connecting rod 3, an intake valve 5, an exhaust valve 6, and a spark plug 7 provided in a head portion 1*c* of the cylinder portion 1*b*, a head cover 8 for covering the head portion 1*c* of the cylinder portion 1*b*, a valve mechanism 9 which operates the intake valve 5 and the exhaust valve 6 according to the rotation of the crankshaft 2, a flywheel 10 connected to an upper end of the crankshaft 2, a recoil starter 11 which is placed above the flywheel 10 and starts the engine E, a top cover 12 which covers the top of engine E, a fuel tank 13 for storing fuel, an air cleaner 14 which purifies the air, a carburetor 15 which produces and supplies a mixture of fuel and air to the cylinder portion 1*b*, a muffler 16 which exhausts the exhaust gas from the cylinder portion 1*b* while muffling the gas, a governor mechanism 17 (see FIGS. 5 and 6) which automatically opens and closes a throttle valve (not illustrated) of the carburetor 15 according to the rotation speed of the crankshaft 2, and an auto choke mechanism 18 which automatically opens and closes the throttle valve of the carburetor 15 according to the temperature of the engine body 1.

[Engine Body]

Figure 4:
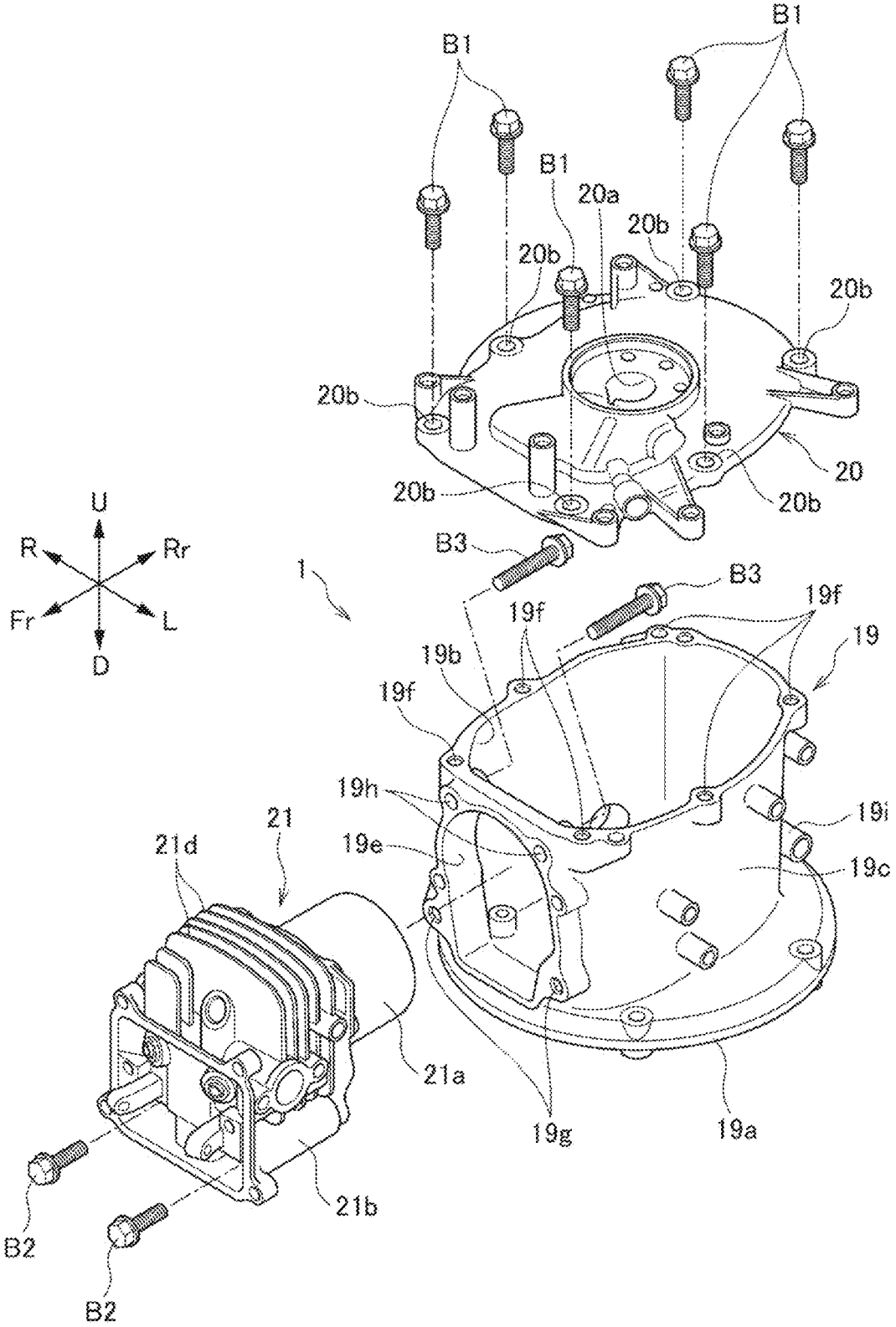
FIG. 4 is an exploded perspective view of an engine body as viewed from diagonally above and front.

As illustrated in FIG. 4, the engine body 1 includes a crankcase body 19, a crankcase cover 20, and a cylinder unit 21.

Figure 5:
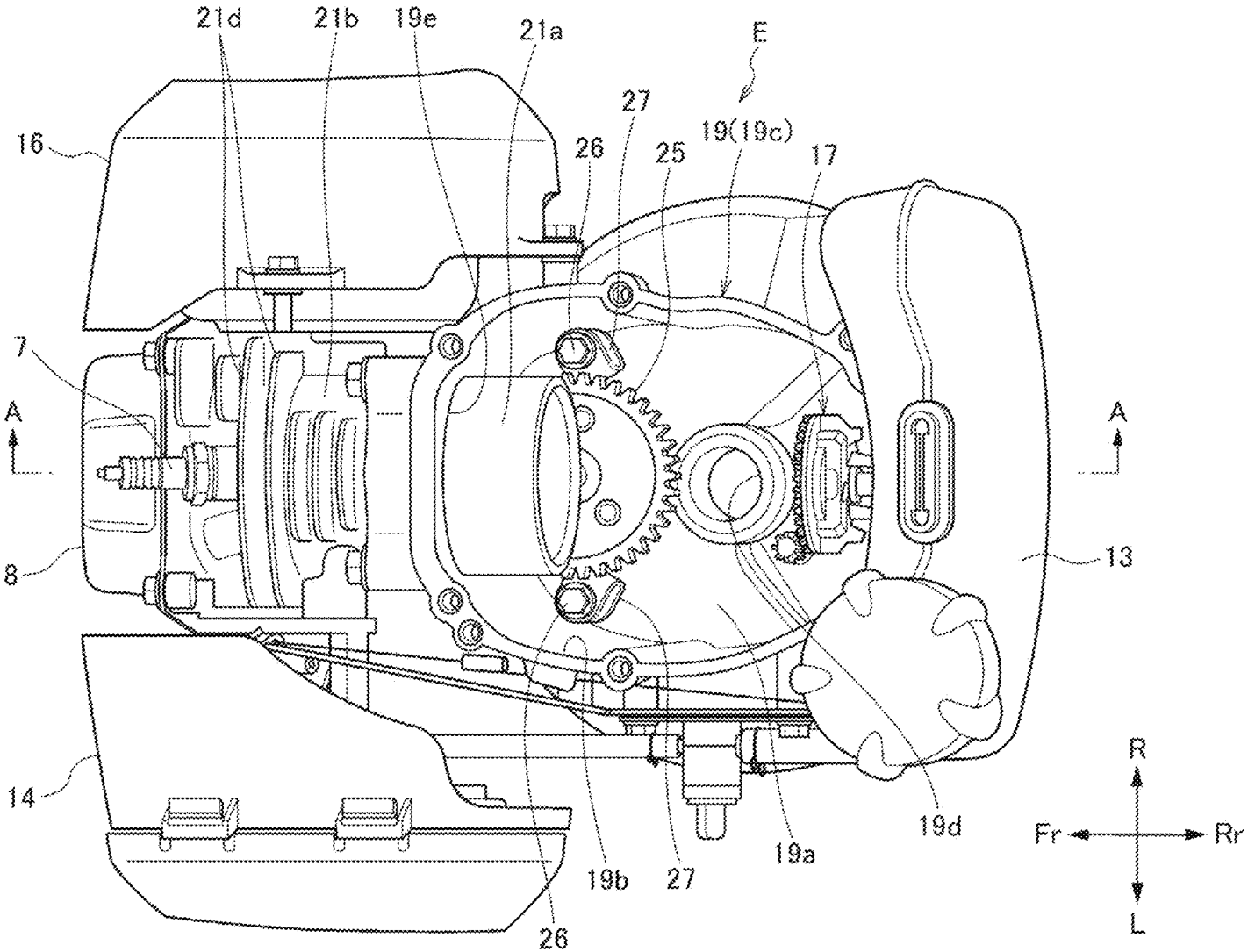
FIG. 5 is a plan view of the engine with a crankcase cover removed.
Figure 6:
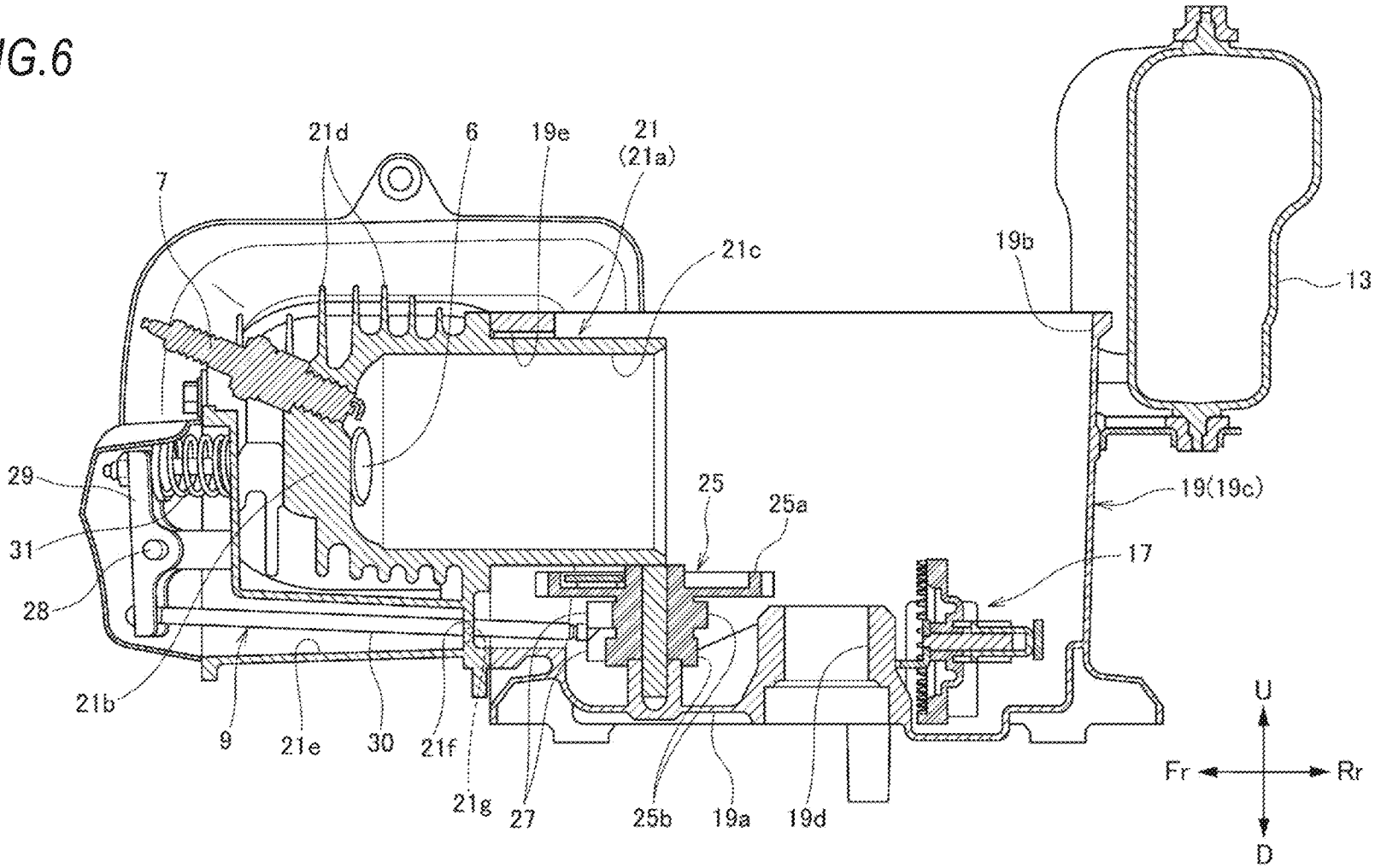
FIG. 6 is a cross-sectional view taken along the line A-A of FIG. 5.

As illustrated in FIGS. 4 to 6, the crankcase body 19 includes a bottom portion 19*a* and a tubular portion 19*c* including the bottom portion 19*a* integrally formed at a lower end portion and a case opening portion 19*b* at an upper end portion. A first crankshaft insertion hole 19*d* into which the lower end side of the crankshaft 2 is inserted is formed in the center of the bottom portion 19*a* and a cylinder insertion hole 19*e* through which the cylinder base portion 21*a* of the cylinder unit 21 is inserted is formed on the front surface of the tubular portion 19*c*. In FIG. 4, reference numerals and letter 19*i* indicate a drain opening for discharging the oil accumulated inside the crankcase portion 1*a*.

As illustrated in FIG. 4, the crankcase cover 20 covers the case opening portion 19*b* of the crankcase main body 19 and forms the crankcase portion 1*a* of the engine body 1 together with the crankcase main body 19. A second crankshaft insertion hole 20*a* into which the upper end of the crankshaft 2 is inserted is formed in the center of the crankcase cover 20. Returning to FIG. 1, the crankshaft 2 is rotatably supported between a second bearing 22 provided adjacent to the second crankshaft insertion hole 20*a* of the crankcase cover 20 and a first bearing 23 provided adjacent to the first crankshaft insertion hole 19*d* of the crankcase body 19.

The crankcase cover 20 is detachably attached to the upper end of the crankcase body 19 via a plurality of bolts B1. Specifically, a plurality of bolt insertion holes 20*b*, through which the bolts B1 are inserted from above, are formed in the peripheral portion of the crankcase cover 20 and a plurality of bolt fastening holes 19*f* into which the bolts B are fastened from above are formed in the upper end of the crankcase body 19. The crankcase cover 20 is attached to the crankcase body 19 by fastening the bolts B1 to the bolt fastening holes 19*f* through the bolt insertion holes 20*b*. Conversely, the crankcase cover 20 can be removed from the crankcase body 19 by releasing the fastening of the bolts B1 from the bolt fastening holes 19*f*.

According to the crankcase body 19 and the crankcase cover 20 as described above, by removing the crankcase cover 20 during maintenance of the engine E, it is possible to access the inside of the crankcase body 19 from above. In particular, when replacing the crankshaft 2, it is possible to easily replace the crankshaft 2 by removing the crankcase cover 20 and pulling out the crankshaft 2.

As illustrated in FIGS. 4 to 6, the cylinder unit 21 includes the cylinder base portion 21*a* which is inserted into the cylinder insertion hole 19*e* of the crankcase body 19 from the front and is located inside the crankcase body 19 and a cylinder block 21*b* which extends forward from the cylinder base portion 21*a* and is located outside the crankcase body 19. The cylinder unit 21 alone forms the cylinder portion 1*b* of the engine body 1 and the front end of the cylinder block 21*b* forms the head portion 1*c*. The cylinder base portion 21*a* and an inner peripheral surface of a cylindrical portion of the cylinder block 21*b* form a cylinder bore 21*c* which is a sliding surface with the piston 4 and a large number of cooling fins 21*d* are provided on the outer peripheral portion of the cylinder block 21*b*.

According to such cylinder unit 21, by preparing a plurality of types of cylinder unit 21 having different bore diameters, it becomes possible to provide an engine body 1 having a different displacement simply by replacing the cylinder unit 21 while making the crankcase body 19 and the crankcase cover 20 common.

The cylinder unit 21 is detachably attached to the crankcase body 19 via a plurality of bolts B2 and B3. For example, when a plurality of bolt insertion holes (not illustrated) through which the bolts B2 are inserted from the front are formed at the rear end of the cylinder block 21*b* and a plurality of bolt fastening holes 19*g* for fastening the bolts B2 from the front are formed at the front end of the crankcase body 19, by fastening the bolts B2 to the bolt fastening holes 19*g* through the bolt insertion holes of the cylinder block 21*b*, the cylinder unit 21 can be attached to the crankcase body 19. Conversely by releasing the fastening of the bolts B2 to the bolt fastening holes 19*g*, the cylinder unit 21 can be removed from the crankcase body 19.

However, in the engine body 1 of the embodiment, when the cylinder unit 21 is detachably attached to the crankcase body 19 via the plurality of bolts B2 and B3, the bolts B3 on the upper end side is fastened to the cylinder unit 21 from the inside of the crankcase body 19. Specifically, a plurality of bolt insertion holes 19*h* through which the bolts B3 are inserted from the inside of the crankcase body 19 toward the front are formed in the front end of the crankcase body 19 and a plurality of bolt fastening holes (not illustrated) for fastening the bolts B3 from the rear are formed at the rear end of the cylinder block 21*b*, and further the bolts B3 is fastened to the bolt fastening holes of the cylinder block 21*b* through the bolt insertion holes 19*h* of the crankcase body 19.

According to such a mounting structure of the cylinder unit 21, since it is not necessary to form a space for fastening the bolts B3 from the front side at least on the upper end side of the cylinder block 21*b*, the cylinder unit 21 can be attached to the crankcase body 19 without disturbing the external structure (for example, the cooling fin 21*d*) of the cylinder block 21*b*, and thus the cooling performance of the engine E can be improved.

[Valve Mechanism]

Figure 7:
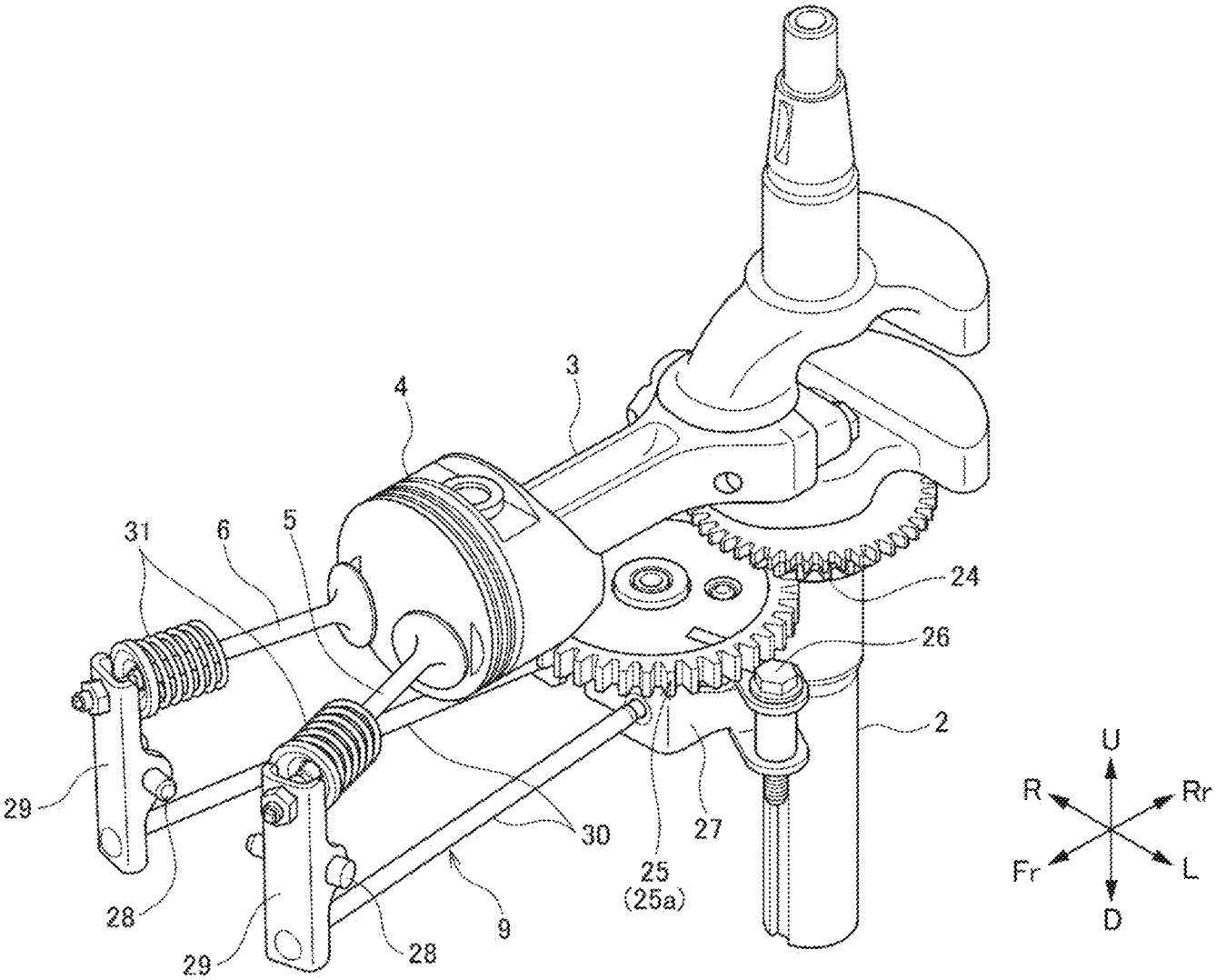
FIG. 7 is a perspective view of a valve mechanism of the engine as viewed from diagonally above and front.
Figure 8:
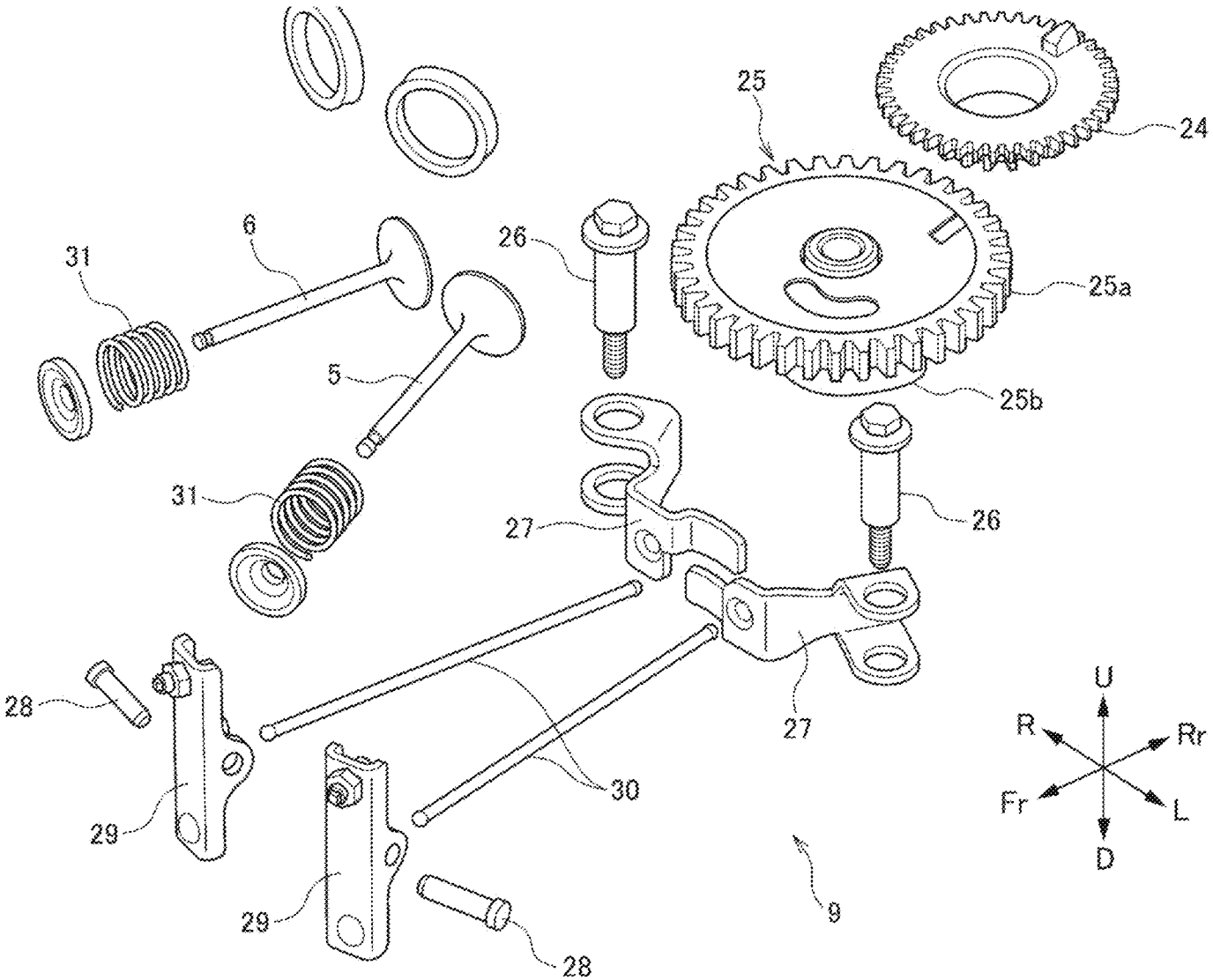
FIG. 8 is an exploded perspective view of the valve mechanism of the engine as viewed from diagonally above and front.

As illustrated in FIGS. 6 to 8, the valve mechanism 9 includes a timing gear 24 fixed to the crankshaft 2, a camshaft 25 rotatably supported on the bottom portion 19*a* of the crankcase body 19, a pair of lifters 27 supported to be swingable on the bottom portion 19*a* of the crankcase body 19 via stepped bolts 26, a pair of rocker arms 29 which are supported to be swingable at the front end of the cylinder block 21*b* via rocker arm shafts 28 and one end of which abuts the front end of the intake valve 5 or the exhaust valve 6, a pair of push rods 30 which are accommodated in a push rod accommodation portion 21*e* formed in the lower part of the cylinder unit 21 and which respectively connect the lifters 27 to the other end portions of the pair of rocker arms 29, and a pair of valve springs 31 for urging the intake valve 5 and the exhaust valve 6 in a closing direction.

A camshaft 25 includes a gear portion 25*a* which meshes with the timing gear 24 and is rotationally driven by the timing gear 24 at a speed reduction ratio of 1/2 and a cam portion 25*b* which alternately pushes the pair of lifters 27 according to the rotational drive of the gear portion 25*a*. When the cam portion 25*b* pushes the lifter 27, the other end of the corresponding rocker arm 29 is pushed through the push rod 30 and the intake valve 5 or the exhaust valve 6 connected to one end of the rocker arm 29 is opened. Conversely, when the pushing of the lifter 27 by the cam portion 25*b* is released, the intake valve 5 or the exhaust valve 6 is closed by the urging force of the valve spring 31.

The camshaft 25 of the embodiment is arranged below the cylinder base portion 21*a* of the cylinder unit 21. When the camshaft 25 is arranged as such, it is possible to access the inside of the crankcase body 19 from the top without removing the camshaft 25 by simply removing the crankcase cover 20 when maintaining the engine E.

In FIG. 6, reference numerals and letter 21*g* indicate a communication hole provided in a rear wall 21*f* of the push rod accommodation portion 21*e*. The communication hole 21*g* is provided at the lowest position when the oil accumulated inside the crankcase portion 1*a* is drained from a drain opening 19*i* of the crankcase body 19 to the outside. The communication hole 21*g* guides the oil accumulated in the head portion 1*c* and the push rod accommodation portion 21*e* to the crankcase portion 1*a*. Therefore, it is possible to more reliably prevent the accumulation of oil in the push rod accommodation portion 21*e* when the oil is discharged.

The embodiment described above can be appropriately modified, improved, and the like. For example, in the embodiment described above, the front-back direction is described as the second direction, but the second direction may be the left-right direction.

Although the cylinder unit 21 is detachable from the crankcase body 19 in the embodiment described above, the cylinder unit 21 may be formed integrally with the crankcase body 19.

SUMMARY

At least the following matters are described in the specification. Although the constituent elements and the like corresponding to those of the embodiment described above are shown in parentheses, the invention is not limited to this.

(1) An engine which includes:

a crankcase body (crankcase body 19) including a bottom portion (bottom portion 19*a*) including a first crankshaft insertion hole (first crankshaft insertion hole 19*d*) and a tubular portion (tubular portion 19*c*) including the bottom portion integrally formed at one end in a first direction and including a case opening portion (case opening portion 19*b*) at the other end in the first direction:

a crankcase cover (crankcase cover 20) including a second crankshaft insertion hole (second crankshaft insertion hole 20*a*) and covering the case opening portion of the crankcase body;

a crankshaft (crankshaft 2) inserted through the first crankshaft insertion hole and the second crankshaft insertion hole:

a cylinder base portion (cylinder base portion 21*a*) located inside the crankcase body; and a cylinder block (cylinder block 21*b*) located outside the crankcase body, where the first direction is an up-down direction of the engine (engine E), and the crankcase cover is detachably attached to an upper portion of the crankcase body.

According to (1), the crankcase cover is detachably attached to the upper portion of the crankcase body. Therefore, by removing the crankcase cover during maintenance of the engine, it is possible to access the inside of the crankcase body from the top. In particular, when replacing the crankshaft, it is possible to easily replace the crankshaft by removing the crankcase cover and pulling out the crankshaft.

(2) The engine according to (1), where a camshaft (camshaft 25) is installed inside the crankcase body, and the camshaft is arranged further on a lower side than the cylinder base portion.

According to (2), the camshaft is located below the cylinder base portion. Therefore, by simply removing the crankcase cover during engine maintenance, it is possible to access the inside of the crankcase body from the top without removing the camshaft.

(3) The engine according to (1) or (2), where the engine includes a valve mechanism (valve mechanism 9), the valve mechanism includes, a timing gear (timing gear 24) fixed to the crankshaft, a camshaft (camshaft 25) rotatably supported by the bottom portion of the crankcase body, a pair of lifters (lifters 27) supported to be swingable on the bottom portion of the crankcase body, a pair of rocker arms (rocker arms 29) which are supported to be swingable via rocker arm shafts (rocker arm shafts 28) and one end of which abuts against an intake valve (intake valve 5) or an exhaust valve (exhaust valve 6), a pair of push rods (push rods 30) for connecting the pair of lifters to the other ends of the pair of rocker arms, and a pair of valve springs (valve springs 31) for urging the intake valve and the exhaust valve in a closing direction, and the pair of push rods are accommodated in a push rod accommodation portion (push rod accommodation portion 21*e*) formed in a lower portion of the cylinder block.

According to (3), the pair of push rods of the valve mechanism are accommodated in the push rod accommodation portion formed in the lower portion of the cylinder block. Therefore, by simply removing the crankcase cover during engine maintenance, it is possible to access the inside of the crankcase body from the top without removing the push rod. Since the push rod accommodation portion is integrally formed in the lower portion of the cylinder block, the number of parts can be reduced. As a result, the manufacturing cost can be reduced.

(4) The engine according to (3), where the push rod accommodation portion is provided with a communication hole (communication hole 21*g*) communicating with the inside of the crankcase body.

According to (4), the oil accumulated in the push rod accommodation portion flows into the crankcase body through the communication hole, so that the accumulation of oil in the push rod accommodation portion can be prevented.

(5) The engine according to (4), where the communication hole is provided at the lowest position when oil accumulated inside the crankcase body is discharged to the outside from a drain opening (drain opening 19*i*) of the crankcase body.

According to (5), since the communication hole is provided at the lowest position when the oil accumulated inside the crankcase body is discharged to the outside from the drain opening of the crankcase body. Therefore, it is possible to more reliably prevent oil from accumulating in the push rod accommodation portion during oil discharge.

DESCRIPTION OF REFERENCE NUMERALS AND CHARACTERS

E: engine

2: crankshaft

5: intake valve
6: exhaust valve
9: valve mechanism
19: crankcase body
19*a*: bottom portion
19*b*: case opening portion
19*c*: tubular portion
19*d*: first crankshaft insertion hole
19*e*: cylinder insertion hole
19*i*: drain opening
20: crankcase cover
20*a*: second crankshaft insertion hole
21: cylinder unit
21*a*: cylinder base portion
21*b*: cylinder block
21*g*: communication hole
21*e*: push rod accommodation portion
24: timing gear
25: camshaft
27: lifter
28: rocker arm shaft
29: rocker arm
30: push rod
31: valve spring

The invention claimed is:

1. An engine comprising:

a crankcase body including a bottom portion including a first crankshaft insertion hole and a tubular portion including the bottom portion integrally formed at one end in a first direction and including a case opening portion at the other end in the first direction;

a crankcase cover including a second crankshaft insertion hole and covering the case opening portion of the crankcase body;

a crankshaft inserted through the first crankshaft insertion hole and the second crankshaft insertion hole;

a cylinder base portion located inside the crankcase body; and a cylinder block located outside the crankcase body, wherein:

the first direction is an axial direction of the crankshaft which is an up-down direction of the engine;

the crankcase cover is detachably attached to an upper portion of the crankcase body;

a camshaft is installed inside the crankcase body;

the camshaft is arranged further on a lower side than the cylinder base portion in the axial direction of the crankshaft, and a shaft portion of the camshaft is arranged between an outer side of the cylinder base portion and an inner side of the crankcase body;

the crankshaft is rotatably supported between a first bearing provided adjacent to the first crankshaft insertion hole of the bottom portion of the crankcase body and a second bearing provided adjacent to the second crankshaft insertion hole of the crankcase cover;

the shaft portion of the camshaft, rotatably supporting the camshaft, extends in the first direction, one end of the shaft portion is supported by the bottom portion of the crankcase body, and the other end of the shaft portion is disposed just below an outer wall of the cylinder base portion; and the camshaft is provided with a gear portion rotatably driven by meshing with a timing gear fixed to the crankshaft, and in a top view in which the crankcase cover is removed, a part of the gear portion is exposed from the cylinder base portion, and a remaining part of the gear portion is covered with the cylinder base portion.

2. The engine according to claim 1, wherein:

the engine includes a valve mechanism;

the valve mechanism includes:

the timing gear fixed to the crankshaft;

the camshaft rotatably supported by the bottom portion of the crankcase body;

a pair of lifters supported to be swingable on the bottom portion of the crankcase body;

a pair of rocker arms which are supported to be swingable via rocker arm shafts and one end of which abuts against an intake valve or an exhaust valve;

a pair of push rods for connecting the pair of lifters to the other ends of the pair of rocker arms; and a pair of valve springs for urging the intake valve and the exhaust valve in a closing direction; and the pair of push rods are accommodated in a push rod accommodation portion formed in a lower portion of the cylinder block.

3. The engine according to claim 2, wherein the push rod accommodation portion is provided with a communication hole communicating with the inside of the crankcase body.

4. The engine according to claim 3, wherein the communication hole is provided at the lowest position when oil accumulated inside the crankcase body is discharged to the outside from a drain opening of the crankcase body.

5. The engine according to claim 1, wherein:

the shaft portion of the camshaft is rotatably supported at an area between the outer side of the cylinder base portion and the inner side of the crankcase body.

* * * * *